United States Patent [19]

Lin

[11] Patent Number: 4,832,217

[45] Date of Patent: May 23, 1989

[54] FUNCTIONALLY LOCKING BOTTLE CAP

[76] Inventor: Ta-Shun Lin, 2-1, 2FL. No. 288, Kuang Fu S. Rd., Taipei, Taiwan

[21] Appl. No.: 198,563

[22] Filed: May 25, 1988

[51] Int. Cl.[4] ..... B54D 55/02

[52] U.S. Cl. ..... 215/220

[58] Field of Search ..... 215/219, 220

[56] References Cited

U.S. PATENT DOCUMENTS 4,729,487 3/1988 Wright ..... 215/220

4,749,093 6/1988 Trick ..... 215/220

*Primary Examiner*—George T. Hall

*Attorney, Agent, or Firm*—Morton J. Rosenberg

[57] ABSTRACT

A functionally locking bottle cap, the feature of which lies mainly in the inclusion of a locking mechanism located in the space between the interior and the exterior of the cap, for which a locking combination number must be set to enable at least one pin to be inserted into at least one pin opening on a selective basis before the bottle cap can be opened. Otherwise an outer cap will rotate freely without causing rotation of an interior cap which is threadably coupled to a container, such as a bottle. Thus making the opening of the container impossible so as to prevent the misue of the contents in the container, by other people.

4 Claims, 13 Drawing Sheets

FUNCTIONALLY LOCKING BOTTLE CAP

BACKGROUND OF THE INVENTION

Most of the conventional bottles and some cans commonly found in commerce have. closures formed by caps which threadably engage the mouth of the container or such closures are formed by cork stoppers, both closures being easily opened. Such easily opened containers have been known to lead to the misuse of the containers contents or use of the contents without Permission which frequently resulted in the causing of accidents. Sometimes these accidents result in incurable events, as in the case of a child's misuse of something poisonous.

Having been well accepted by consumers, bottles and can type containers have become very common in the marketplace. However, the aforementioned defects found in closures for these containers have not yet been overcome. Accidental injurious o fatal events caused by the misuse of medicine are frequently reported in the news. Therefore, the existence and value of a functionally locking bottle cap is well justified. However, no prior art device known to the applicant provides a locking function as provided by the instant invention. Known prior art, such as Taiwan Patent #T4209519 disclosing a Sealed Cap for a Container where the seal cap includes a seal element having a changeable shape to achieve the object of having the container sealed. However, no locking mechanism is provided by this prior art device, which allows the cap of the bottle to be easily opened with no possibility to achieve the object of preventing accidents by unauthorized use of the containers contents.

SUMMARY OF THE INVENTION

This invention is related to a functionally locking bottle cap, particularly denoting a bottle cap for which the setting up of a locking combination number makes it impossible for the other people, not having the combination, to open the cap. The locking cap features a locking mechanism located in the space between the interior and the exterior caps. A locking combination number is set by making use of a convex pin and a corresponding pin opening of the locking mechanism to lock the bottle cap to the container. When the pin of an indication ring is not in alignment with the preset locking combination number, the exterior caps will rotate freely, thus making the opening of the container by removal of the cap impossible, so as to prevent the misuse or use without permission of the contents in the container by other people. The design of this invention is focused on the existing defects currently found in the caps of bottles. The instant invention provides a device in which a locking combination number can be set to prevent others from freely opening the container to which the locking cap is applied, so as to achieve the object of safety.

DETAILED DESCRIPTION OF PREFERRED EMBODIMENT

Figure 1:
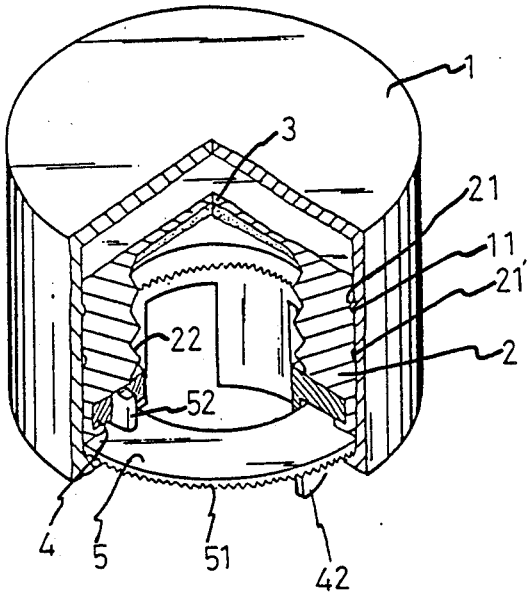
FIG. 1 is a solid cross-section view of the structure of this invention.
Figure 2:
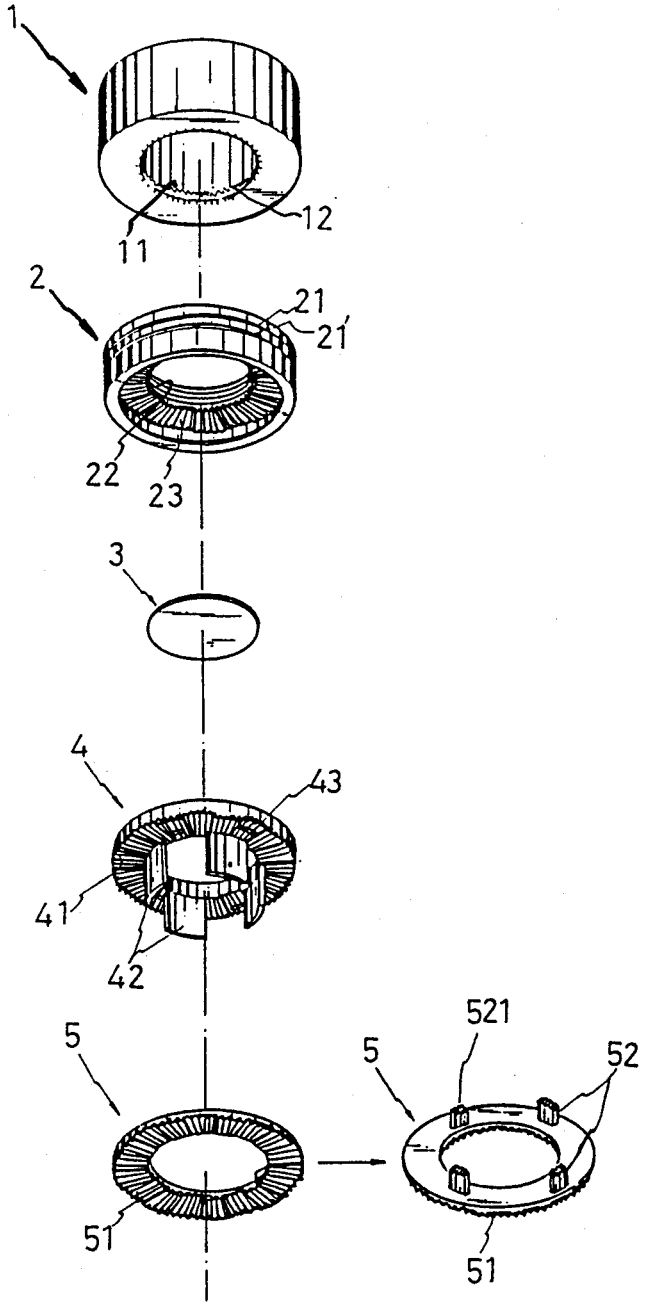
FIG. 2 is a solid segmentation drawing of the structure of this invention.
Figure 3:
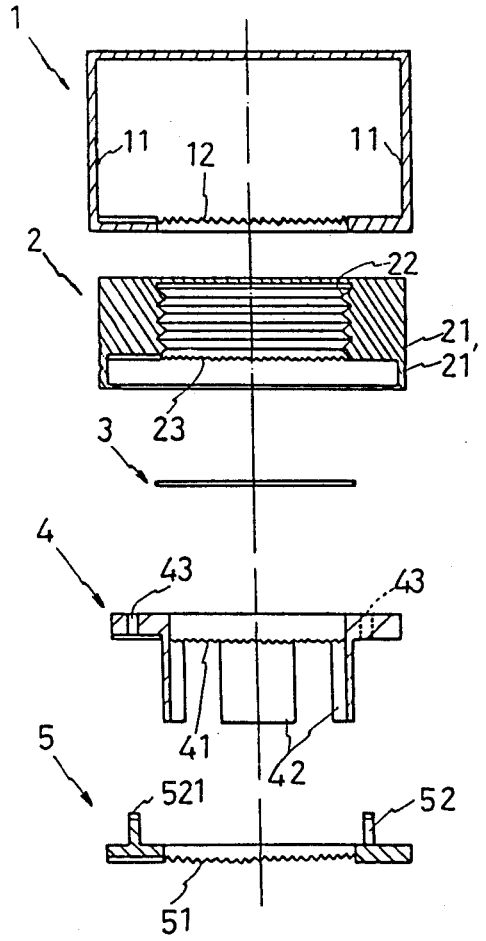
FIG. 3 is a cross-section segmentation drawing of this invention.

As shown by FIGS. 1, 2 and 3, this invention comprises an exterior cap 1, an interior cap 2, a water-proof cushion ring 3, and indication ring 4 and a pin ring 5, wherein at least two small convex projections 11 are set at an appropriate height on the interior wall of the exterior cap 1. Exterior cap 1 having its bottom portion projected horizontally toward a central opening to form the shape of a channel rail having geartooth-like projections 12 set on the plane of the horizontally projected portion and, also having many numerals (indicia) marked as required at the lower portion of the exterior wall of the exterior cap 1, as a means to lock or unlock the cap of a bottle. The interior cap 2 is located in the interior space of the exterior cap 1 and is shorter in length than the exterior cap 1, having water-proof cushion ring 3 tightly fixed onto the top end of the interior wall of the interior cap 2. Interior cap 2 includes at least two annular concave grooves 21, 21' being dimensioned for receiving the convex projections 11 and positionally located appropriately on the exterior wall of the interior cap 2 to align with projections 11 to provide two operative positions and for slidingly joining together exterior cap 1 and interior cap 2. Female threads 22 are located at the upper end of the interior wall of interior cap 2 for threadedly engaging a container. A system of geartooth-like projections 23 are also located at the upper portion of the interior cap 2, extending from the bottom of the female threads 22 to the interior wall of the interior cap 2. A channel or step extends from the lower edge of the wall of the interior cap 2 and extends to the geartooth-like projections 22 to form a smooth interior wall which provides a recess of a depth substantially equal to the thickness of the indication ring 4, as a means to provide a location for the indication ring 4 and a means to retain it.

The top surface of the indication ring 4 is a smooth plane and its bottom surface is formed by gear tooth-like projections 41 with a plurality of thin and long indication pins 42 each extending downward an equal distance from the interior edge of the bottom surface. The indication ring 4 also includes a plurality of slotted through pin openings 43 unsymmetrically positioned on indication ring 4 to mate with pin ring 5 in only one orientation. Pin ring 5 includes a plurality of projecting pins 52 for insert into pin openings 43. Tee bottom surface of pin ring 5 includes geartooth-like projections 51 and includes a smooth plane on its upper surface. The top edge surface of pin 52 also includes geartooth-like projections 521. When pin 52 passes through the pin opening 43 of the indication ring 4 the teeth 521 will then mesh with teeth 23 at the bottom of the interior cap 2, while simultaneously the indication pin 42 of the indication ring 4 will pass through the interior edge of the annular pin ring 5 to extend below the outside bottom edge of the exterior cap 1, so as to facilitate the unlocking of the bottle cap. Having a plurality of indications pins 42 provides convenience for pushing the pin ring 5 into position to set a locking number. By interfacing a plurality of pins 52 with a plurality of pin openings 43 both of which are unsymmetrical in their positions, and the multiplicity of numerals located on the exterior cap, the rate of accidentally unlocking the cap will be reduced to a minimum. For example, out of the 100 locking numbers which are located on the exterior cap, only one of the numbers can unlock the cap of the bottle. However, such a number must be in alignment with a particular one out of the plurality of indication pins before the unlocking can occur. This makes the chance of randomly choosing the correct combination drop from 1 out of 100 to that of one out of several hundreds. Therefore, it will be more difficult for an unauthorized person to unlock the container cap.

Figure 4A:
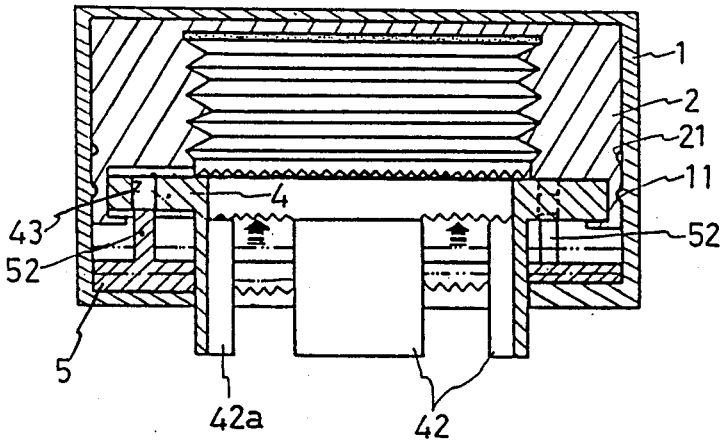
FIGS. 4A and 4B are lock-up motional drawings of this invention.
Figure 4B:
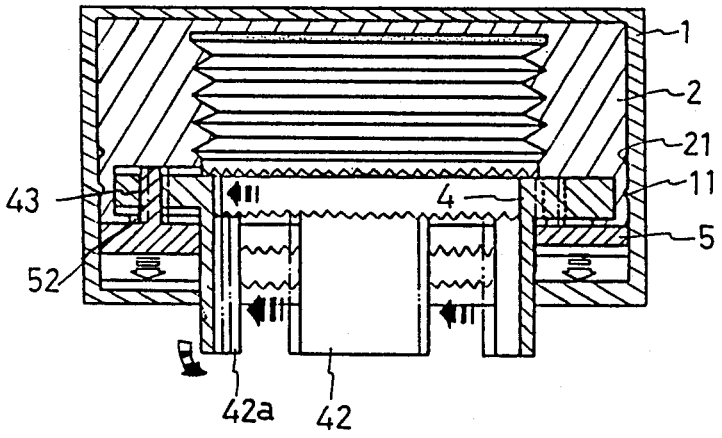

Referring to FIGS. 4A and 4B, as received from the factory and prior to enabling a locking number for the bottle cap of this invention, the projections 11 of the interior wall of exterior cap 1 are located within the upper concave groove 21 in the exterior wall of the interior cap 2, and the pins 52 of the pin ring 5 inserted into the pin openings 43 of the indication ring 4. At this point the cap of the bottle can easily be opened, as any ordinary bottle cap. If a user wants to make use of the locking function of this invention, all he has to do is lightly push the pin ring 5 to cause it to be separated from the exterior cap 1 (as shown in FIG. 4A) and cause it to rotate. At this point, the pins 52 of the pin ring 5 will mesh with the indication ring 4 to cause both to rotate together until they are stopped at a particular pin 42*a*, so as to be in alignment with a particular number on the exterior cap 1, which the user intended to use as the combination number for setting the lock, and thus completing the procedure, as shown in FIG. 4B. Exterior cap 1 is then pushed down to cause the projections 11 to be transferred from groove 21 to be seated within the lower concave groove 21 on the exterior wall of the interior cap 2. This action causes the pins 52 on the pin ring 5 to move away from the pin opening 43, so that the rotating force of the exterior cap 1 cannot be transferred to the interior cap 2, providing free rotation of the exterior cap 1 that prevents opening of the cap of the bottle, so as to achieve the object of locking up the bottle cap.

Figure 5A:
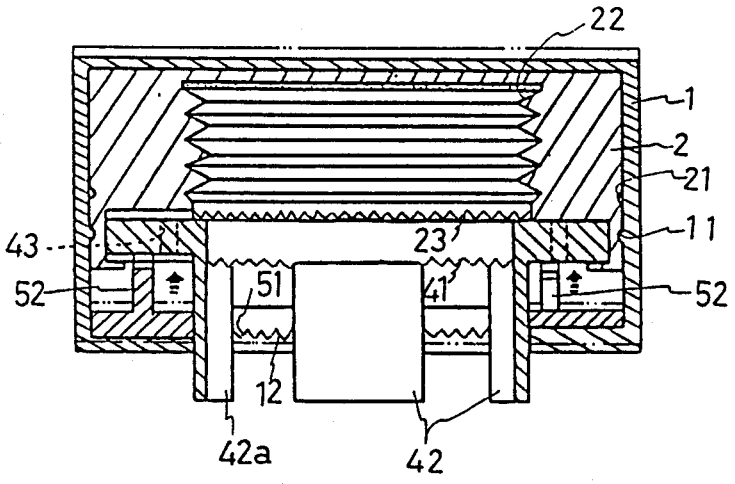
FIGS. 5A, 5B and 5C are motion indicative drawings of this invention.

After having set the lock number according to the aforementioned description, the cap is pressed down and rotated so that the indication pin 42A will no longer be in alignment with the locking number, which had previously been set (as shown in FIG. 5A). Subsequently, if the exterior cap 1 is being pulled upward, drawing pin rings upward toward ring 4, the pins 52, due to their not being in alignment with the pin openings 43, will not be able to pass through the aforementioned openings 43 to contact the teeth 23 of interior cap 2. Thus the force applied to rotate the exterior cap 1 will be passed by the teeth 12 located at the bottom of the exterior cap to the pin ring 5. From pin ring 5 the force is passed by the pins 52 to the indication ring 4. Because the top surface of the indication ring 4, which contacts the teeth 23 on the bottom surface of interior cap 2, is a smooth plane, the indication ring 4 will rotate freely in accord with the pin ring 5 and the exterior cap 1 without transferring opening force to cap 2. As long as pins 52 are not in alignment with the pin openings 43, exterior cap 1 will rotate idly, not being rotatively coupled to interior cap 2.

Figure 5B:
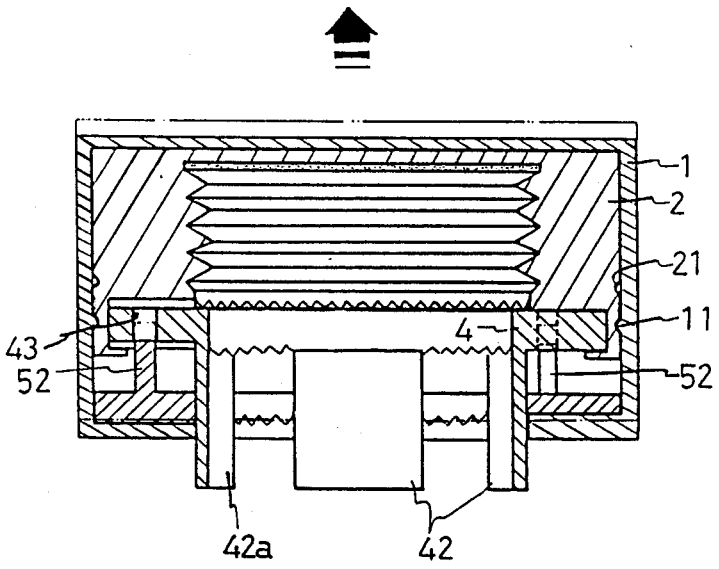
Figure 5C:
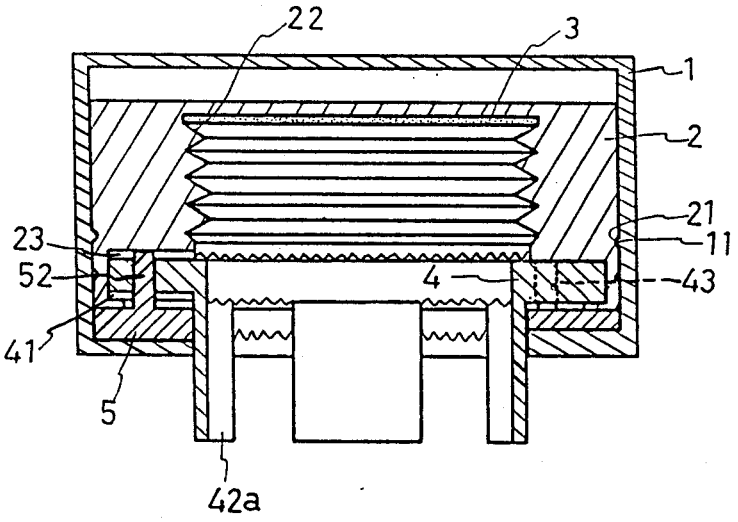

It would be easy for anyone who knows the locking combination number to open the cap of the bottle. All that must be done is to rotate the exterior cap, until it reached the locking combination number aligning it with the particular indication pin 42*a* (as shown in FIG. 5B). The exterior cap 1 is thin pulled upward. The pins 52, then being in alignment with the pin openings 43 will pass through the pin openings 43 to contact the bottom teeth 23 of interior cap 2 (as shown in FIG. 5C). The projections 11 located on the interior wall of the exterior cap 1 is thereby seated into and positioned in the upper concave groove 21 on the exterior wall of the interior cap 2. Thus providing the means of passing a force applied to the exterior cap 1 through the teeth 12 to the teeth 23, drivingly coupling caps 1 and 2 providing a synchronized rotational displacement thereof, so as to open the container by removal of the locking cap.

Figure 6:
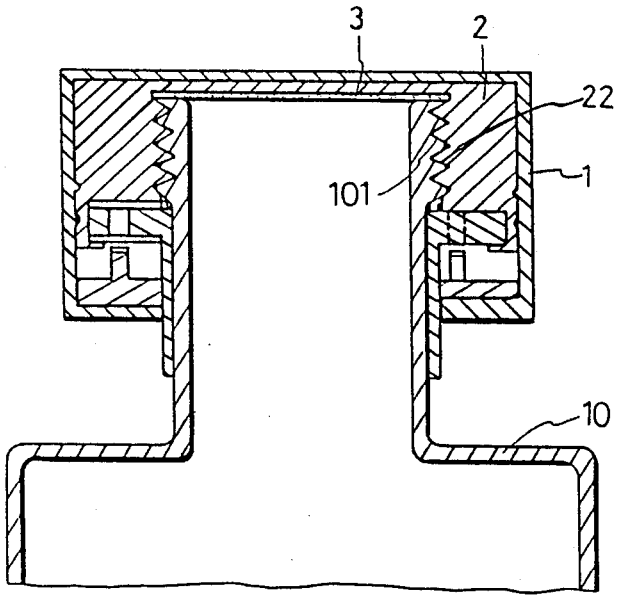
FIG. 6 is an indicative drawing which shows the utilization of this invention in coordination with a bottle.

FIG. 6 shows the coupling scheme of the bottle cap and the opening of the container-bottle 10 as disclosed by this invention, in which the male thread 101 of the bottle 10 can only be screwed together with the female thread 22 of the interior cap 2. Therefore, under a locking condition, it would be impossible to open the cap of the bottle by rotating its exterior cap 1. This will prevent the contents in the bottle from being misused or used without permission.

Figure 7:
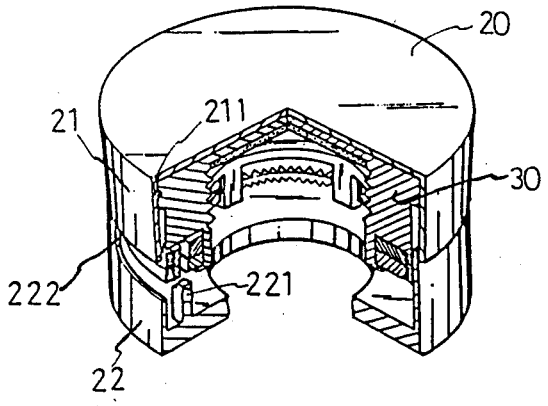
FIG. 7 is a structural solid cross-section drawing of another embodiment of this invention.
Figure 8:
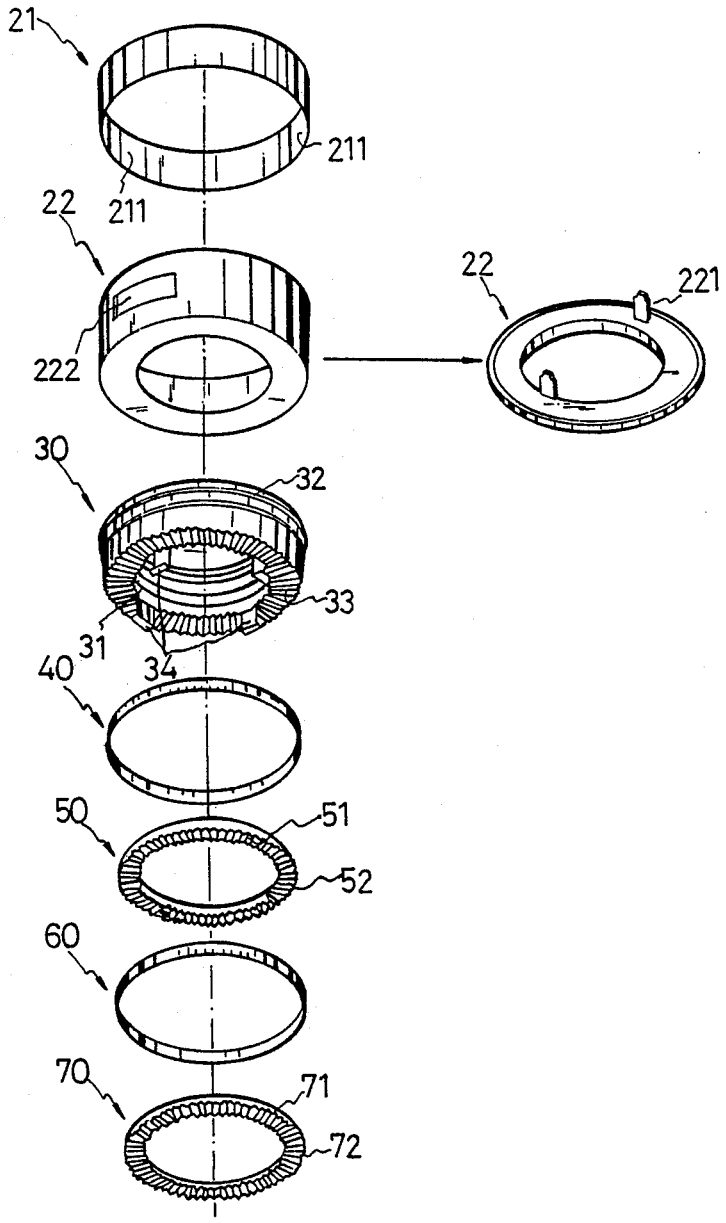
FIG. 8 is a structural segmentation drawing of another embodiment of this invention; and, FIGS. 9A and 9B are motion indication drawings of another embodiment of this invention.

In addition, the structure of another embodiment of this invention featuring a locking function is shown in FIG. 7 and FIG. 8 respectively, wherein the structure of cap of a container includes an exterior cap 20, an interior cap 30, two indication rings 40 and 60 and two locking rings 50 and 70, in which the exterior cap 20 is formed by two half bodies i.e. the upper half 21 and the lower half 22. The lower end of the upper half body 21 is comparatively smaller than the upper end of the upper half body 21, and the top portion of the lower half body 22 is comparatively larger than the lower end of the upper half body 21. The upper half of the half body 22 is inserted inside the upper half body 21 to integrally form a flexible exterior cap 20 having its bottom portion projected horizontally inward to form a channel rail, also having two unsymmetrical pins 221 extending from the horizontal portion.

With gear teeth located on the top plane of the pins 221, the upper half body 21 includes at least two projections 211 located on the interior surface. The lower half body 22 includes a window 222 located at an appropriate position of the lower half body 22 to facilitate the rotating of both indication ring 40 and 60 with a person's fingers, to set up a locking combination number or unlocking the cap.

The length of the interior cap 30 is smaller than that of the exterior cap 20, making it possible to be displaced vertically within the exterior cap 20. A female thread 31 is located on the interior wall of interior cap 30 be be screwed together with the threaded portion of the bottle. The exterior surface of cap 30 includes a pair of concave grooves 32 to receive the projections 211 on the interior wall of the exterior cap 20 for slidingly coupling caps 20 and 30 to form two operative positions. Interior cap 30 further includes a plurality of gear teeth 33 located on its bottom surface to be driven by the rotation of the pins 221. Four fixed feet 34 are extended downwardly from the interior edge of the interior cap 30. The aforementioned fixed feet have a portion bent 90° outwardly to capture the indication rings 40 and 60 and the locking rings 60 and 70. The interior edges of the indication rings 40 and 60 are smooth, and their exterior surface is marked by numerals. The locking rings 50 and 70 are placed inside the indication rings 40 and 60 to provide a compact coupling. The interior edges of locking rings 50 and 70 are smooth. Each ring 50 and 70 includes a plurality of gear teeth 52 and 72 respectively, on their bottom surface. Each of rings 50 and 70 also includes at least two pin openings 51 and 71 respectively, for receipt of pins 221.

Figure 9A:
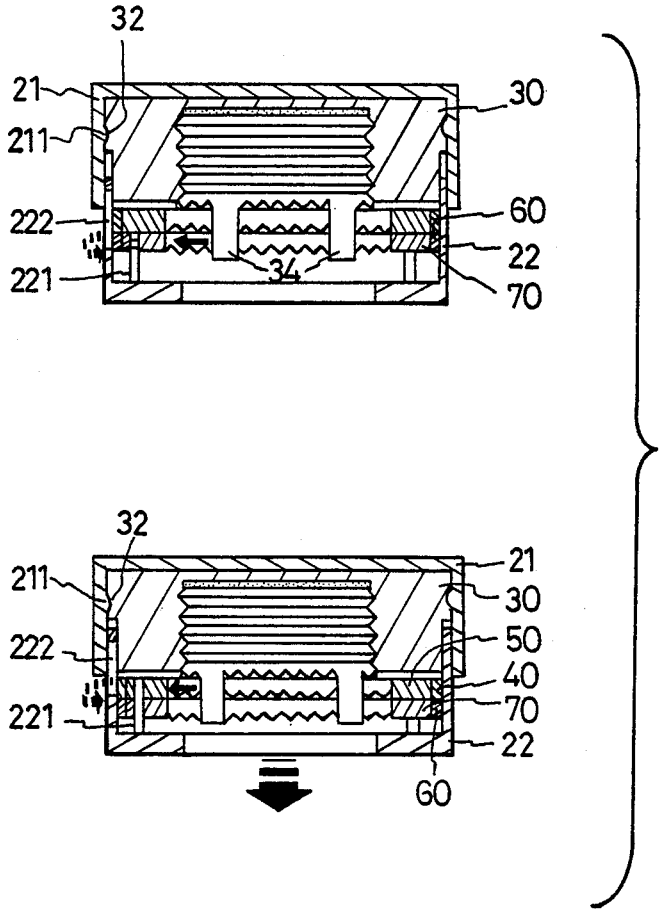
Figure 9B:
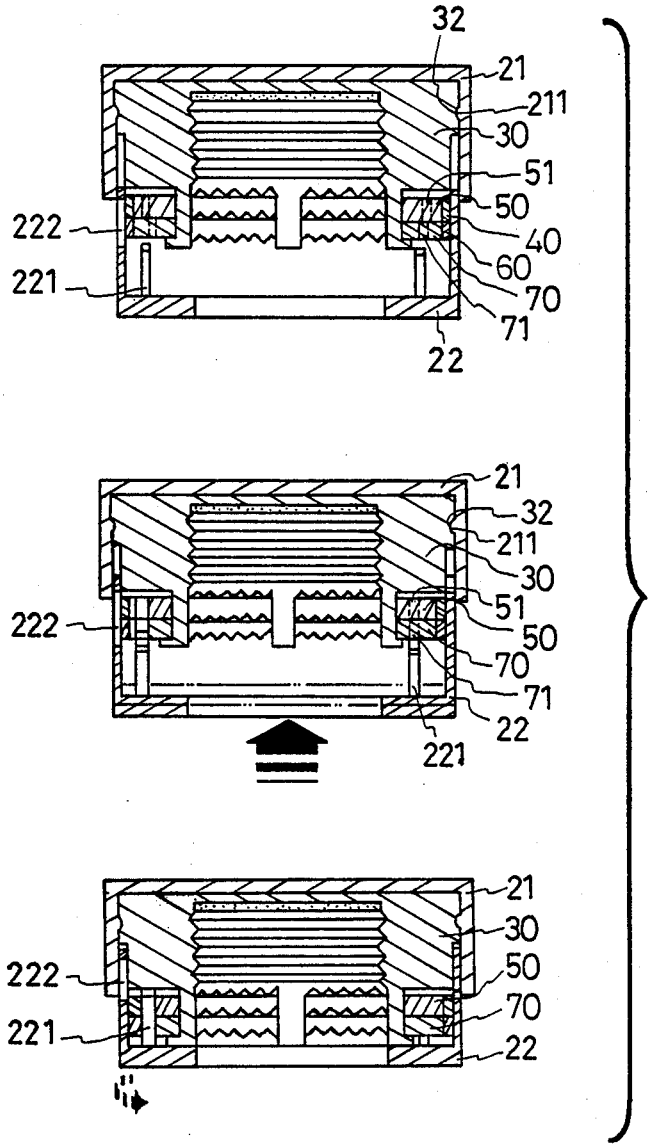

When this locking cap is provided to the user, no locking number is set. The pins 221 at the bottom part of the exterior cap 20 passing through the pin opening 51 and 71 to contact and mesh with the teeth 33 of the interior cap to drive the rotating of the interior cap responsive to rotation of the exterior cap for the opening of the cap of the bottle. If the cap is to be used for locking a container, the exterior cap 20 must be held while the indication ring 40 is rotated through window 222 until it reaches a selected number. Then indication ring 60 is similarly rotated until it reaches a selected number. The lower half part 22 of the exterior cap 20 is then pulled downward and the pins 221 will then be separated from the pin opening 51 and 71. The two locking rings 50 and 70 are next rotated so that pin opening 51 will not be in alignment with pin opening 71. This reduces the probability of unlocking (as shown in FIG. 9A) the cap by random selection of numbers. The exterior cap 20 cannot now rotatively operate the interior cap 30, resulting in the impossible opening of the bottle cap. If the cap of the bottle has to be opened, the exterior cap is rotated until a little triangular mark 224 located at the lower edge of the window 222 aligns with the number which had been selected on the indication ring 60. The lower half body 22 is then pulled up to allow the pins 221 to be inserted into the pin openings 71. Next, the exterior cap is rotated until a second little triangular mark 223 located on the upper edge of the window 222 is aligned with the number which had been selected on the indication ring 40. The lower hald body 22 is then pulled up to enable the pins 221 to be inserted into the pin openings 51. In this way, both the exterior and the interior caps can be rotated together to open the bottle.

Two indication rings and two locking rings are used in this embodiment to increase the probability of a correct random selection of the combination numbers and thus reduce the probability of cap opening by mere guessing. The use of two pins 221 increases their coupling strength. In order not to increase the probability of unlocking by guessing, it is so designed that the positional locations of the two aforementioned pins is unsymmetrical about the rotative axis of cap 20.

The structure of the aforementioned functionally locking bottle cap described herein, provides new and improved practical functions to substantially prevent unauthorized people from opening the cap of a bottle or can at will.

I claim:

1. A functionally locking bottle cap comprised mainly of:

An exterior cap, having convex dots set at a certain appropriate height of its interior wall with a channel rail projected out of its horizontal bottom part, also having tooth threads set on its convex part and numerals (or marks) set at its lower periphery as a means to set the locking number;

An interior cap, which is set inside the exterior cap, having a concave groove on its upper wall, so that it can be housed with the convex dots of the exterior cap; threads are set on the upper end of the interior wall to be screwed together with the threads on the bottle opening, tooth threads are also set horizontally at the bottom part of the threads, a channel groove is formed by extending from the lower direction of the tooth threads toward the direction of the exterior wall, so as to form a smooth interior wall of appropriate thickness;

An indication ring, which is placed inside the channel groove of the smooth interior wall at the lower direction of the interior cap tooth threads, having its upper plane made in the form of a smooth plane and its bottom fitted with tooth threads and pin openings; indication pins are designed to extend downward from their interior edge, also having different marks made on the indication pins for indication purposes;

A pin ring, which is set projectedly out of groove rail tooth threads of the horizontal exterior cap, through its interior edge the indication pin will pass through the exterior cap, having tooth threads at its bottom plane to facilitate their being activated by the exterior cap, on the upper plane of which there are several opposing convex pins coordinated with several pin openings, so as to facilitate locking or unlocking;

By means of the above-mentioned structures, this invention is equipped with a locking function to prevent other people from opening the bottle cap or the misuse or use without permission of the contents which are being kept in the bottle or can.

2. The functionally locking bottle cap as described in claim 1, which can, under an unlocking condition, also pull up the exterior cap until the convex dots on the interior wall are housed into the concave groove on the exterior wall of the interior cap for positioning to enable the convex pin to be potentially passing through the pin opening, so as to eliminate its locking function, as well as to let it be utilized as an ordinary bottle cap.

3. The functionally locking bottle cap as described in claim 1, the exterior cap of which can also be designed in the form of a flexible body, with convex dots to be set on its interior wall, with a window also opened on its wall, having a groove rail projected out at its horizontal base; also set are several convex pins, on which there are tooth threads, with a concave groove set at the exterior wall of the interior cap, at the bottom plane of which tooth threads are set to activate the convex pin, with fixed foot extended from its lower directions, having a locking mechanism provided for locking purpose.

4. The functionally locking bottle cap as described in claim 3, of which the locking mechanism is comprised of two indication rings and two locking rings which have marks labelled on their two exterior edges, in which the locking rings are located inside the indication rings for a comparatively closer coupling, having tooth threads set at its bottom, also having pin openings coordinated with convex pins set on their rings to facilitate the passing through of the convex pin, so as to activate the tooth thread on the bottom plane of the interior cap as means to open the bottle cap.

* * * * *